US005573432A

United States Patent [19]

Hatagishi

[11] Patent Number: 5,573,432

[45] Date of Patent: Nov. 12, 1996

[54] PRESS-CONNECTING CONNECTOR

[75] Inventor: Yuji Hatagishi, Shizuoka, Japan

[73] Assignee: Yazaki Corporation, Tokyo, Japan

[21] Appl. No.: 501,291

[22] Filed: Jul. 12, 1995

[30] Foreign Application Priority Data

Jul. 22, 1994 [JP] Japan ..... 6-171349

[51] Int. Cl.[6] ..... H01R 13/514

[52] U.S. Cl. ..... 439/752; 439/459

[58] Field of Search ..... 439/752, 466, 439/468, 459

[56] References Cited

U.S. PATENT DOCUMENTS 4,243,288 1/1981 Lucius et al. ..... 339/99

5,282,760 2/1994 Almasso .

5,403,212 4/1995 Almasso .

*Primary Examiner*—Gary F. Paumen

*Assistant Examiner*—T. C. Patel

*Attorney, Agent, or Firm*—Sughrue, Mion, Zinn, Macpeak & Seas

[57] ABSTRACT

A press-connecting connector includes a housing, and wires, connected to respective press-connecting terminals, are extended out from the housing. There is provided an outer cover for receiving the housing. A housing insertion window is formed in one side wall of the outer cover, so that the housing can be inserted into the outer cover through the housing insertion window, with one side wall of the housing first introduced into the outer. A wire passage window is formed through an upper wall of the outer cover at a rear end portion thereof, and the wires are passed outwardly from the outer cover through the wire passage window.

6 Claims, 4 Drawing Sheets

47
61
65
53
59
55
41
37
45
51
49
39
42
57
63
35
43
33
67
31

PRESS-CONNECTING CONNECTOR

BACKGROUND OF THE INVENTION

1. Field of the Invention

This invention relates to a press-connecting connector receiving press-connecting terminals, and more particularly to a strain relief structure for absorbing a tension acting on a wire.

2. Background

FIG. 6 shows one conventional press-connecting connector disclosed in U.S. Pat. No. 4,243,288 which connector comprises a housing receiving press-connecting terminals, and cover members.

In this press-connecting connector 1, the press-connecting terminals 3 each having a press-connecting blade are put respectively into a plurality of terminal receiving chambers 5 formed in the housing 7, and wires 9 are press-connected to the corresponding press-connecting terminals 3, respectively. Then, the cover members 11 are attached to the housing 7, thereby protecting the press-connecting terminals 3, connected to the respective wires, from an external force.

In this conventional press-connecting connector 1, a plurality of projections 13 formed on a front end of the upper cover member 11 are retainingly engaged respectively in grooves 15 formed in a rear end of an upper wall of the housing 7, and also a plurality of projections 13 formed on a front end of the lower cover member 11 are retainingly engaged respectively in grooves 15 formed in a rear end of a lower wall of the housing 7. Then, the two cover members 11 each having retaining piece portions 17 and 19 are opposed to the upper and lower sides of the housing 7, respectively, and the plurality of wires 9 are passed in a juxtaposed manner through an insertion opening 21 formed between the retaining piece portions 17 and 19, and then a retaining projection **17*a* of each retaining piece portion 17 is engaged with a retaining step 19*a* of the associated retaining piece portion 19, so that the two cover members 11 are lockingly attached respectively to the upper and lower sides of the housing 7 in such a manner that the housing 7 is interposed between the two cover members 11**.

In the conventional press-connecting connector 1, however, the wire 9 is held only by a wire clamping portion of the press-connecting terminal 3, and the housing 7 as well as the cover member 11 has no devices for holding the wire 9. Therefore, when the wire 9 is pulled in a direction of arrow A upon application of an external force thereto, the wire is protected against this tension only by a clamping force provided by the wire clamping portion (not shown). Thus, this clamping force is quite weak, so that the wire 9 is liable to be disengaged from the press-connecting terminal 3, and even if the wire 9 is not disengaged from the terminal 3, an incomplete electrical contact occurs.

In the press-connecting connector 1, when the cover members 11 are to be lockingly attached respectively to the upper and lower sides of the housing 7, the plurality of wire 9 must be passed in a juxtaposed manner through the insertion opening 21, thus inviting a disadvantage that the efficiency of the cover-attaching operation is poor.

Furthermore, in the conventional press-connecting connector 1, at least three component parts, that is, one housing 7 and two cover members 11, are needed. Thus, the number of the component parts is rather large, and the management of supply of the parts is rather troublesome, and besides the manufacturing cost is increased.

SUMMARY OF THE INVENTION

The present invention has been made in view of the above problems, and an object of the invention is to provide a press-connecting connector in which wires are protected from an external tension, and the assembling of the connector can be effected easily, thereby enhancing the reliability and the efficiency of the operation, facilitating the management of supply of the parts, and reducing the manufacturing cost.

The above object has been achieved by a press-connecting connector of the invention comprising a housing wherein wires, connected to respective press-connecting terminals, are extended out from the housing; including an outer cover for receiving the housing; a housing insertion window is formed in one side wall of the outer cover, so that the housing can be inserted into the outer cover through the housing insertion window, with one side wall of the housing first introduced into the outer cover; and a wire passage window is formed through an upper wall of the outer cover at a rear end portion thereof, the wires being passed outwardly from the outer cover through the wire passage window.

The housing is inserted into the outer cover through the housing insertion window, and the wires extending out from the rear end of the housing are passed through the wire passage window, and the wires are bent at an upper edge of a rear wall of the outer cover to extend horizontally rearwardly, so that each wire has a bent portion. The rear wall serves as a tension-absorbing plate for absorbing tension applied to the wires, and the tension acting on the wires are thus absorbed by the rear wall, so that the tension will not act directly on press-connecting portions of the wires.

The wires extending out from the rear end of the housing are received into the wire passage window at a time when the housing is inserted into the outer cover, and therefore when the cover is to be attached to the housing, it is not necessary that the wires should be arranged in a juxtaposed manner as in the conventional construction.

DETAILED DESCRIPTION OF THE PREFERRED EMBODIMENTS

A preferred embodiment of a press-connecting connector of the present invention will now be described in detail with reference to the drawings.

Figure 1:
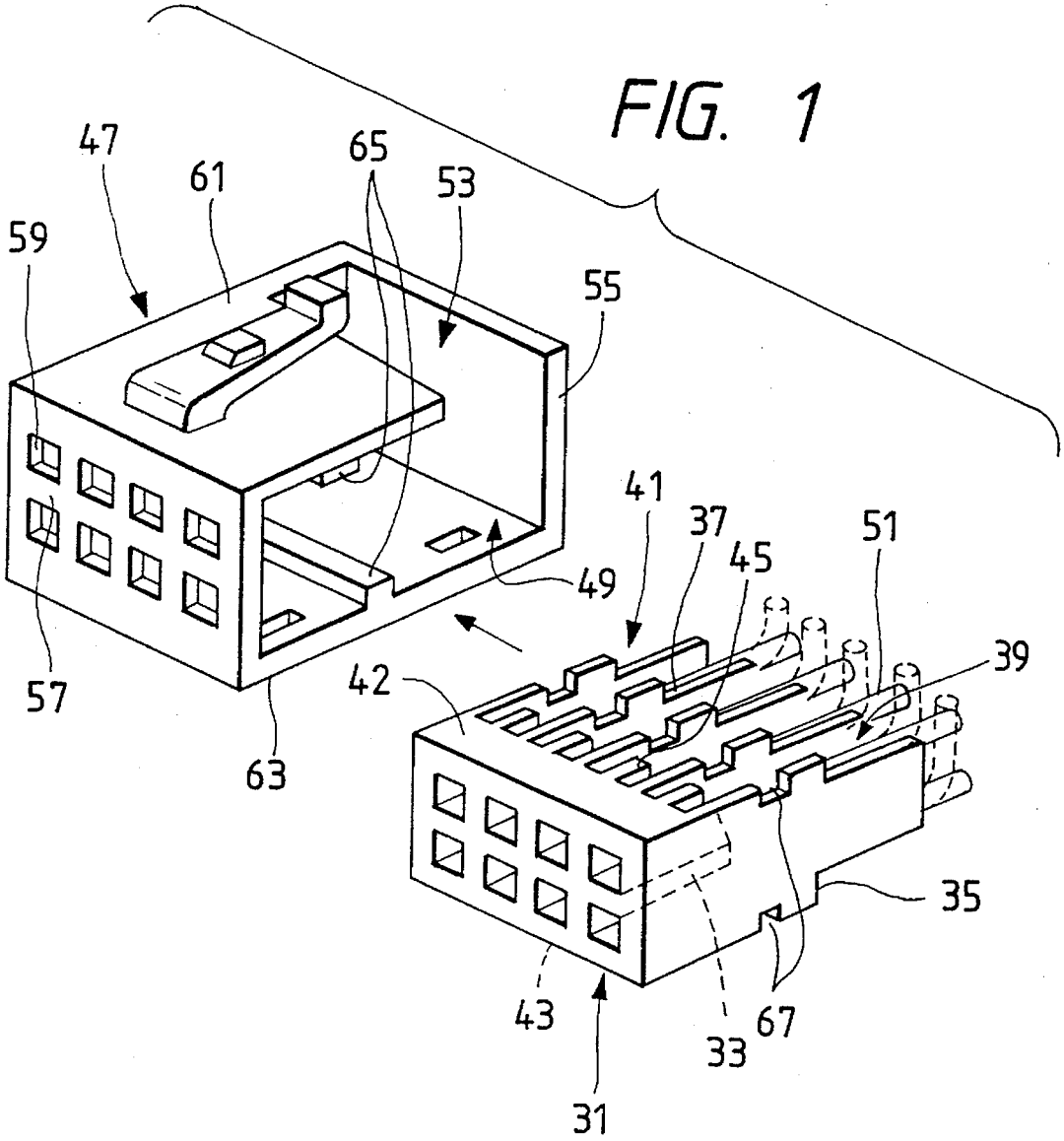
FIG. 1 is a perspective view of a press-connecting connector of the invention, showing a housing and a cover.
Figure 2:
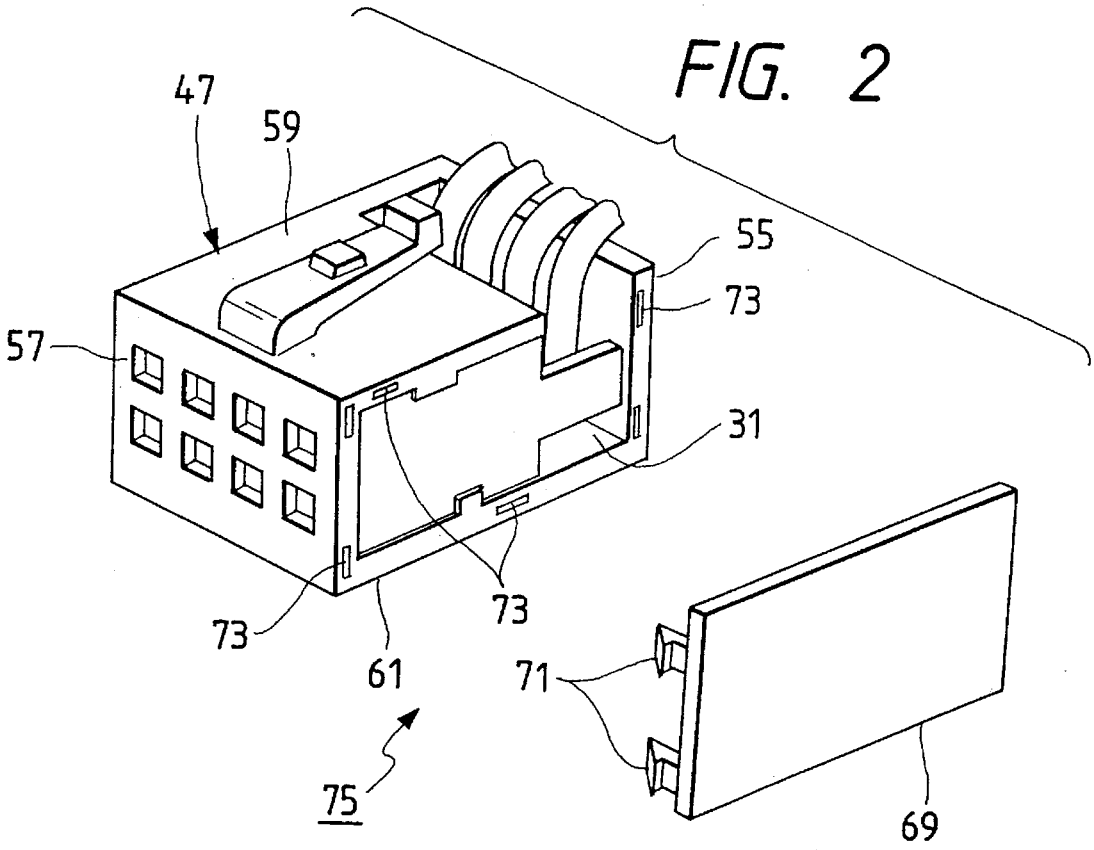
FIG. 2 is a view explanatory of the manner of assembling the press-connecting connector of the invention.

FIG. 1 is a perspective view of the press-connecting connector, showing a housing and a cover, and FIG. 2 is a view explanatory of the manner of assembling the press-connecting connector of the invention.

The housing 31 has a horizontal base plate 33 formed centrally of a height thereof, and this horizontal base plate 33 divides the housing 31 into an upper portion and a lower portion. A pair of vertical side plates 35 are formed respectively on opposite side edges of the horizontal base plate 33. A plurality of vertical partition walls 37 are formed on each of the upper and lower sides of the horizontal base plate 33, and the partition walls 37 form a plurality of terminal receiving chambers 39 between the opposite side plates 35. Each terminal receiving chamber 39 has a wire press-connecting opening 41. The housing 31 has an upper wall 42 and a lower wall 43 which are provided at front end portions of the opposite side walls 35 and the partition walls 37. Because of the provision of the upper and lower walls 42 and 43, the front end portions of the terminal receiving chambers 39 are formed into pocket portions for respectively receiving electrical contact portions of press-connecting terminals. A plurality of elastic retaining piece portions (lances) 45 of the cantilever type are formed on each of the upper and lower walls 42 and 43, and correspond respectively to the terminal receiving chambers 39.

The box-like outer cover 47 is removably attached to the outer periphery of the housing 31. A housing insertion window 49 is formed in one side wall of the outer cover 47, and the housing 31, having wires 51 extending rearwardly therefrom, can be inserted into the outer cover 47 through the housing insertion window 49. A wire passage window 53 is formed in an upper wall of the outer cover 47 at a rear end portion thereof, and is continuous with the housing insertion window 49. When the housing 31 is received in the outer cover 47, the wires 51 extending out of the housing 31 can be passed through the wire passage window 53. The wire passage window 53 is thus provided, and an upstanding rear wall 55 of the outer cover 47 is disposed rearwardly of the housing 31 received in the outer cover 47. The wire passage window 53 may be separate from the housing insertion window 49.

A plurality of male terminal-receiving holes 59 are formed through a front wall 57 of the outer cover 47, and are disposed so as to correspond respectively to the terminal receiving chambers 39 in the housing 31 when the housing 31 is received in the outer cover 47.

A pair of guide rails 65 are formed respectively on inner surfaces of upper and lower walls 61 and 63 of the outer cover 47, and extend in a direction of insertion of the housing 31. The guide rail 65 is adapted to be engaged in notches 67 formed in the opposite side walls 35 and the partition walls 37. Also, the guide rail 65 is adapted to engage the associated press-connecting terminals. Namely, the housing 31 is inserted into the outer cover 47, with each guide rail 65 engaged in the associated notches 67. By doing so, the housing can be inserted easily, and the housing is prevented from shaking within the outer cover 47.

A lid 69 (see FIG. 2) is removably attached relative to the housing insertion window 49 in the outer cover 47. Retaining pawls 71 are formed on and project from one side of the lid 69, and these retaining pawls 71 are retainingly engaged in respective retaining holes 73 formed in rear edges of the front wall 57, upper wall 61, lower wall 63 and rear wall 55 of the outer cover 47, thereby fixing the lid 69 relative to the housing insertion window 49.

The press-connecting connector 75 comprises, as main component parts and portions, the housing 31, the outer cover 47, the housing insertion window 49, the wire passage window 53, the guide rails 65, the notches 67 and the lid 69.

For assembling the press-connecting connector 75, the press-connecting terminals 79 (see FIG. 3) are received respectively into the terminal receiving chambers 39 in the housing 31, so that each press-connecting terminal 79 is retained by the associated lance 45 against withdrawal. Then, each wire 51 is press-connected to the associated press-connecting terminal 79.

Then, the wires 51 extending out from the rear end of the housing are upwardly bent perpendicularly, and in this condition the housing 31 is inserted into the outer cover 47 through the housing insertion window 49, with the wires 51 passed through the wire passage window. At this time, the insertion of the housing 31 is effected with the guide rails 65 engaged in the notches 67.

After the housing 31 is inserted into the outer cover 47, the wires 51 are bent rearwardly at the upper edge or end of the rear wall 55 to extend horizontally.

Then, the lid 69 is attached relative to the housing insertion window 49 in the outer cover 47, so that the housing 31 is prevented from being disengaged from the outer cover 47, and also is protected from the exterior, thus completing the assembling of the press-connecting connector 75.

Figure 3:
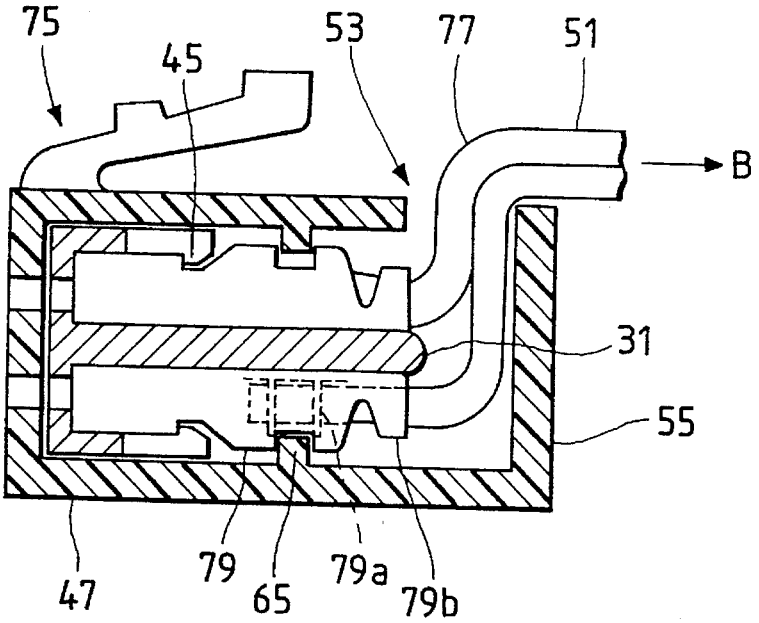
FIG. 3 is a cross-sectional view of the press-connecting connector of the invention in its assembled condition.

The operation of the press-connecting connector 75 of the above construction will now be described. FIG. 3 is a cross-sectional view showing the assembled condition of the press-connecting connector of the invention.

In the press-connecting connector 75, the wires 51 extending out from the rear end of the housing 31 are passed through the wire passage window 53, and are bent rearwardly at the upper edge of the rear wall 55 to extend horizontally, thereby forming a bent portion 77 at each wire 51. Namely, the rear wall 55 of the outer cover 47 serves as a tension-absorbing plate for absorbing tension applied to the wires 51, thus forming a so-called strain relief structure. With this construction, the tension acting on the wire 51 in a direction of arrow B is absorbed by the rear wall 55, and will not act directly on a press-connecting portion **79*a* of the associated press-connecting terminal 79**.

When the housing 31 is inserted into the outer cover 47, with the guide rails 65 engaged in the notches 67, each press-connecting terminal 79 is retained by the associated guide rail 65 (see FIG. 3), and is thus retained in a double manner by the lance 45 and the guide rail 65.

Figure 6:
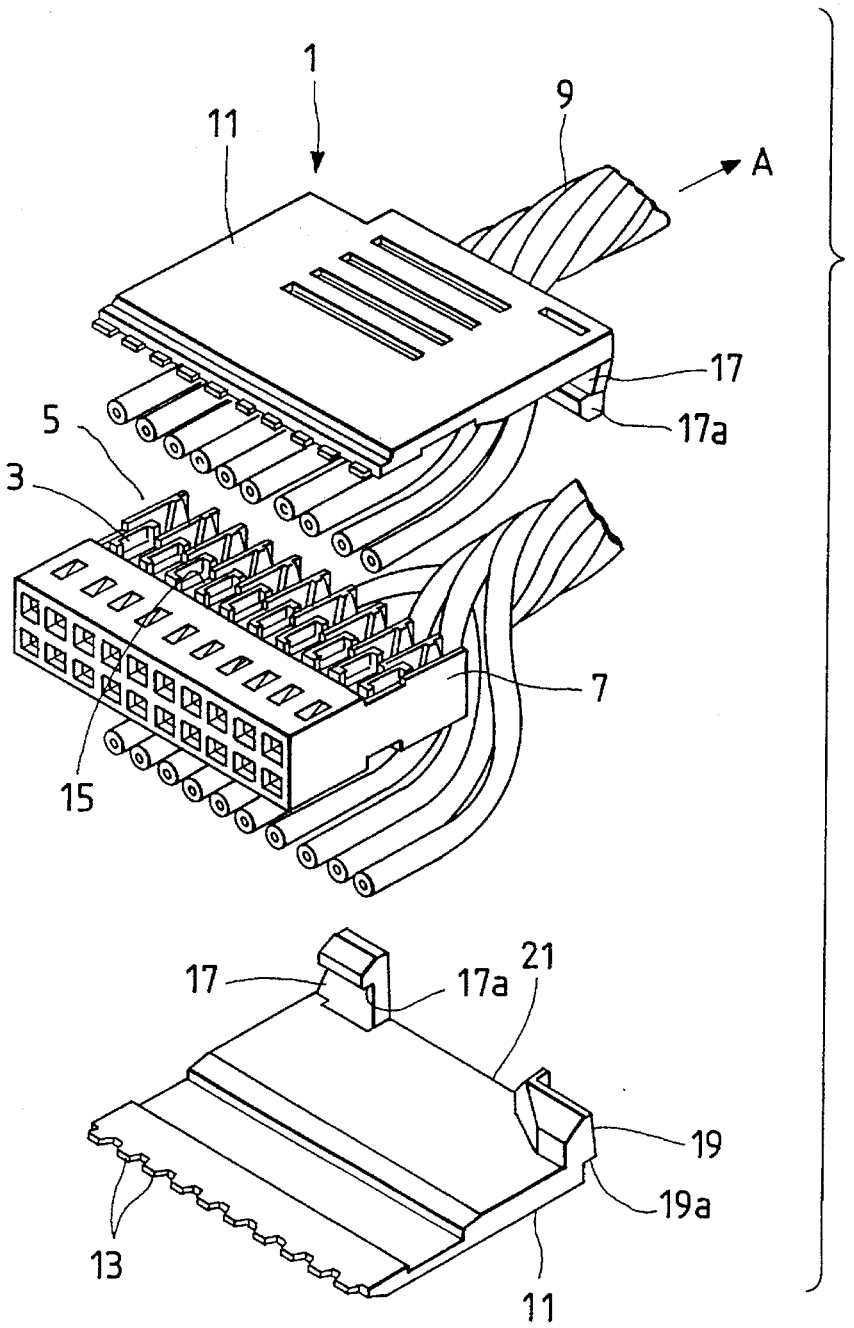
FIG. 6 PRIOR ART
FIG. 6 is an exploded, perspective view of a conventional press-connecting connector.

The wires 51, extending out from the rear end of the housing 31, are upwardly bent together adjacent to wire connection portions **79*b* of the press-connecting terminals 79, and the wires 51 are received into the wire passage window 53 at a time when the housing 31 is inserted into the outer cover 47. In the conventional construction, when the cover members 11 are to be attached to the housing 7 (see FIG. 6), the wires 9 must be passed in a juxtaposed manner through the insertion opening 21 formed between the two cover members 11 in such a manner that the wires 9** should not be held between the cover member and the housing. In the present invention, however, with the above construction, such an operation is not necessary.

The above press-connecting connector 75 has the strain relief structure provided by the rear wall 55 by which the wires 51 are bent, and therefore even if the wire 51 is pulled by an external force in the direction of arrow B, this tension can be absorbed by the bent portion 77 of the wire 51, thereby protecting the wire press-connecting portion from the tension. As a result, the disengagement of the wire 51 from the press-connecting terminal 79, as well as an incomplete electrical contact, can be positively prevented.

Furthermore, since the wires 51, extending out from the rear end of the housing 31, can be received into the wire passage window 53 at a time when the housing 31 is inserted into the outer cover 47, the efficiency of the assembling operation is greatly enhanced.

Figure 4:
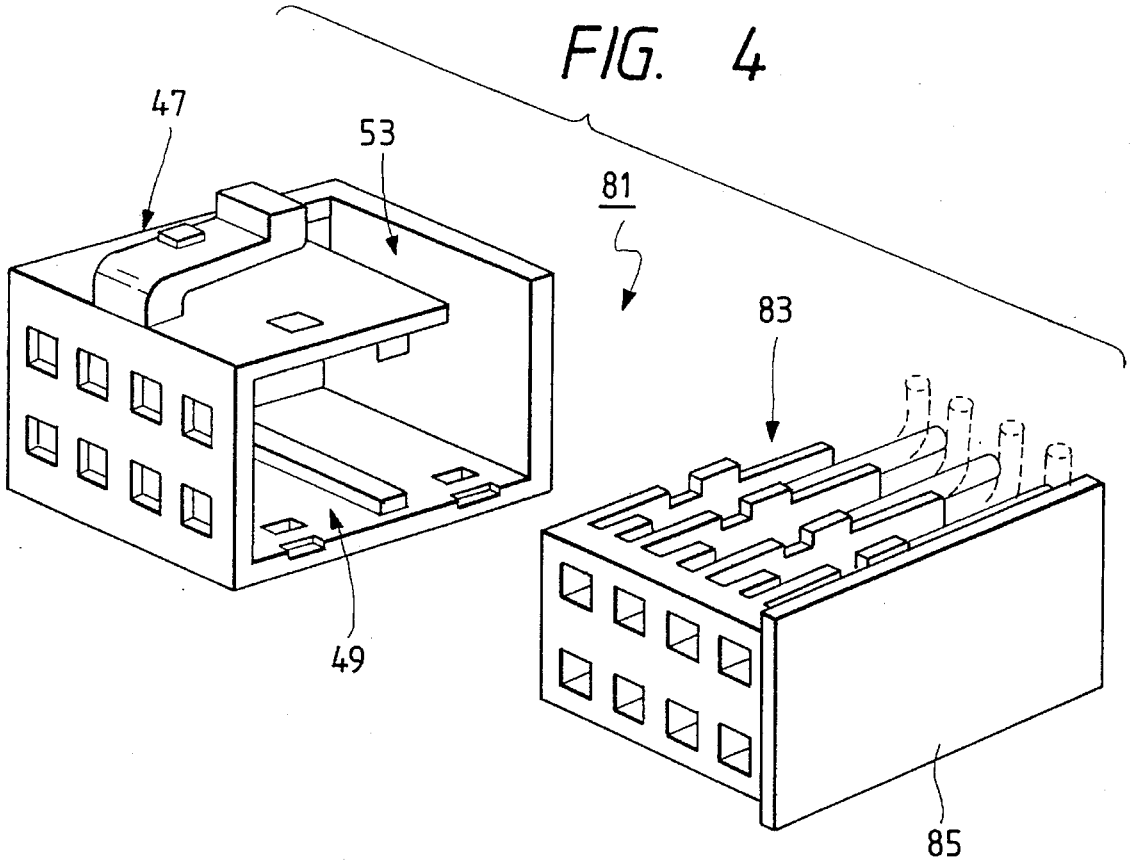
FIG. 4 is a perspective view of another preferred embodiment of a press-connecting connector of the invention.

Next, another preferred embodiment of a press-connecting connector of the invention will now be described. FIG. 4 is a perspective view of this press-connecting connector.

The press-connecting connector 81 of this embodiment has the same outer cover 47 as used in the above press-connecting connector 75, but has a housing 83 different from the housing of the preceding embodiment. More specifically, a lid 85 is formed integrally on one side of the housing 83, and when the housing 83 is inserted into the outer cover 47, the lid 85 closes a housing insertion window 49 in the outer cover 47, as described above for the lid 69 of the preceding embodiment. Since the lid 85 is formed integrally with the housing 83, the press-connecting connector 81 is constituted by the two component parts.

In the press-connecting connector 81 of this embodiment, the number of the component parts is smaller than that of the conventional press-connecting connector (see FIG. 6), and the management of supply of the parts is facilitated, and the manufacturing cost can be reduced.

Figure 5:
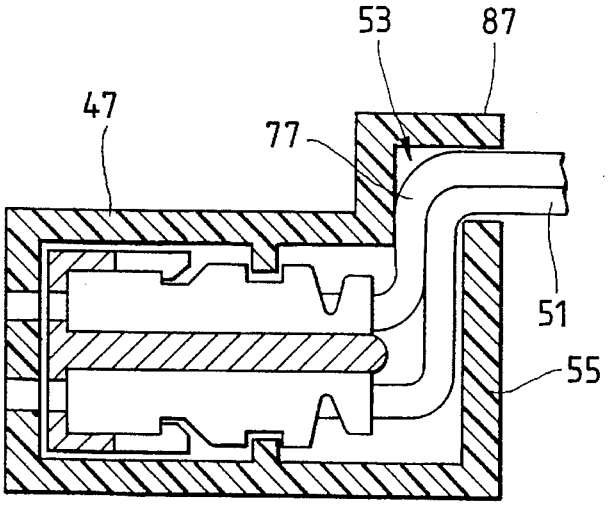
FIG. 5 is a cross-sectional view of a modified form of the invention in which a wire holding portion is provided.

In the above press-connecting connectors 75 and 81, it is preferred that a wire holding portion 87 should be formed on the outer cover 47 adjacent to the wire passage window 53, as shown in FIG. 5. With this construction, the wires 51, extending through the wire passage window 53, are held between the upper edge of the rear wall 55 and the wire holding portion 87, so that the wires 51 can be positively bent, and can be retained in the predetermined direction.

As described above in detail, in the press-connecting connectors of the present invention, the housing insertion window and the wire passage window are formed in the outer cover, and therefore the wires extending out from the rear end of the housing are bent, and even if each wire is pulled by an external force, this tension can be absorbed by the bent portion of the wire, so that the disengagement of the wire from the press-connecting terminal, as well as an incomplete electrical contact, can be positively prevented. And besides, the wires extended out from the rear end of the housing can be received into the wire passage window at a time when the housing is inserted into the outer cover. Therefore, the reliability of the press-connecting connector, as well as the efficiency of the assembling operation, can be greatly enhanced.

What is claimed is:

1. A connector, comprising:

a housing having a terminal receiving chamber for receiving a terminal including an electrical contact portion and a wire connecting portion for connecting a wire, said terminal receiving chamber being defined by partition walls on opposite sides thereof, a horizontal base plate and an outer wall;

a retaining member, for retaining said electrical contact portion, formed at said outer wall;

an outer cover for accommodating said housing;

a terminal receiving hole formed to correspond to said terminal receiving chamber through a front wall of said outer cover;

a housing insertion window, for receiving said housing, formed in a side wall of said outer cover; and a wire passage window formed in an upper wall adjacent an upper edge of a rear wall of said outer cover, said wire being passed through said wire passage window to allow said wire to bend around said rear wall such that said wire assumes an S-shape and said rear wall absorbs a tension to said wire.

2. The connector of claim 1, wherein a lid portion is integrally formed on an outer side of said partition walls, and engages with said housing insertion window.

3. The connector of claim 1, further comprising:

a lid member for covering said housing insertion window.

4. The connector of claim 1, wherein a wire holding portion formed on said wire passage window.

5. The connector of claim 1, further comprising:

a guide rail formed on an inner surface of said outer cover; and notches formed on said partition walls, respectively, wherein said guide rail engages with said notches.

6. The connector of claim 5, wherein said guide rail engages with said terminal into said housing received in said outer cover.

* * * * *